US009186687B2

(12) United States Patent
Häggmark et al.

(10) Patent No.: US 9,186,687 B2
(45) Date of Patent: Nov. 17, 2015

(54) CENTRIFUGAL SEPARATOR WITH PRESSURE OR RECIRCULATION CONTROL OR MONITORING DEVICES

(75) Inventors: Carl Häggmark, Täby (SE); Sverker Danielsson, Bromma (SE); Peter Thorwid, Sundbyberg (SE); Roland Isaksson, Grödinge (SE); Hans Moberg, Stockholm (SE); Johan Agrell, Täby (SE); Anders Svensson, Saltsjöboo (SE)

(73) Assignee: Alfa Laval Corporate AB, Lund (SE)

( * ) Notice: Subject to any disclaimer, the term of this patent is extended or adjusted under 35 U.S.C. 154(b) by 461 days.

(21) Appl. No.: 13/575,366

(22) PCT Filed: Jan. 28, 2011

(86) PCT No.: PCT/SE2011/050091
§ 371 (c)(1),
(2), (4) Date: Sep. 28, 2012

(87) PCT Pub. No.: WO2011/093784
PCT Pub. Date: Aug. 4, 2011

(65) Prior Publication Data

US 2013/0029828 A1 Jan. 31, 2013

(30) Foreign Application Priority Data

Jan. 29, 2010 (SE) ..... 1000085

(51) Int. Cl.
*B04B 11/02* (2006.01)
*B04B 13/00* (2006.01)

(52) U.S. Cl.
CPC ..... *B04B 11/02* (2013.01); *B04B 13/00* (2013.01)

(58) Field of Classification Search
CPC ..... B04B 11/02; B04B 13/00
USPC ..... 494/1–6, 10–11, 35, 37, 42, 68–73
See application file for complete search history.

(56) References Cited

U.S. PATENT DOCUMENTS 2,532,792 A * 12/1950 Svensjo ..... 494/1
2,628,021 A * 2/1953 Staaff ..... 494/35

(Continued)

FOREIGN PATENT DOCUMENTS

CA 2124818 C 4/1994
CA 2241539 A1 1/1999

(Continued)

OTHER PUBLICATIONS

International Search Report for PCT/SE10/050091, dated May 5, 2011.

*Primary Examiner* — Charles Cooley
(74) *Attorney, Agent, or Firm* — MKG, LLC

(57) ABSTRACT

A system includes a hermetic centrifugal separator, a recirculation system, a first monitoring system, a first control system, a pressure monitoring system, and a pressure control system. The separator includes a rotor, a separation chamber, an inlet channel for separating components, a first outlet channel for receiving separated light components, and a second outlet channel for receiving separated heavy components. The recirculation system recirculates the separated heavy components from the second outlet channel to the separation chamber. The first monitoring system monitors density and/or flow rate of the heavy components in the second outlet channel. The first control system controls flow rate in response to a control signal from the first monitoring system. The pressure monitoring system monitors pressure in the second outlet channel. The pressure control system controls a back pressure valve in the second outlet channel in response to a control signal from the pressure monitoring means.

41 Claims, 4 Drawing Sheets

(56) References Cited

U.S. PATENT DOCUMENTS

| | | | | | |
|---|---|---|---|---|---|
| 3,201,036 | A | | 8/1965 | Halbach et al. | |
| 3,445,061 | A | * | 5/1969 | Carl-Goran | 494/3 |
| 3,593,915 | A | * | 7/1971 | Steinacker | 494/3 |
| 3,640,452 | A | * | 2/1972 | Thylefors | 494/1 |
| 3,750,940 | A | * | 8/1973 | Nilsson | 494/3 |
| 3,752,389 | A | * | 8/1973 | Nilsson | 494/3 |
| 3,938,734 | A | * | 2/1976 | Wilke | 494/11 |
| 3,976,242 | A | * | 8/1976 | Hemfort | 494/3 |
| 3,982,162 | A | * | 9/1976 | Olliffe | 388/811 |
| 4,083,488 | A | * | 4/1978 | Gunnewig | 494/27 |
| 4,149,668 | A | * | 4/1979 | Zurbruggen | 494/2 |
| 4,151,950 | A | * | 5/1979 | Gunnewig | 494/2 |
| 4,278,200 | A | | 7/1981 | Gunnewig | |
| 4,305,817 | A | * | 12/1981 | Kohlstette | 210/104 |
| 4,411,645 | A | * | 10/1983 | Tenthoff | 494/3 |
| 4,475,897 | A | * | 10/1984 | Bradtmoller | 494/35 |
| 4,505,697 | A | * | 3/1985 | Lee et al. | 494/35 |
| 4,525,155 | A | * | 6/1985 | Nilsson | 494/3 |
| 4,536,285 | A | * | 8/1985 | Karlsson | 210/96.1 |
| 4,622,029 | A | * | 11/1986 | Nilsson | 494/2 |
| 4,643,709 | A | * | 2/1987 | Lee et al. | 494/37 |
| 4,662,866 | A | | 5/1987 | Ehnstrom | |
| 4,755,165 | A | * | 7/1988 | Gunnewig | 494/37 |
| 4,759,744 | A | * | 7/1988 | Krook | 494/35 |
| 4,810,374 | A | * | 3/1989 | Bruning et al. | 210/104 |
| 4,820,256 | A | * | 4/1989 | Nordstrom | 494/3 |
| 4,840,612 | A | * | 6/1989 | Pallmar | 494/2 |
| 5,104,371 | A | * | 4/1992 | Ajnefors | 494/27 |
| 5,199,938 | A | * | 4/1993 | Kohlstette et al. | 494/10 |
| 5,300,014 | A | * | 4/1994 | Chin et al. | 494/35 |
| 5,423,340 | A | * | 6/1995 | Campbell et al. | 134/110 |
| 5,601,523 | A | * | 2/1997 | Knelson | 494/29 |
| 5,800,330 | A | * | 9/1998 | Modeer | 494/2 |
| 5,899,844 | A | * | 5/1999 | Eberle, Sr. | 494/37 |
| 6,080,098 | A | * | 6/2000 | Borgstrom et al. | 494/27 |
| 6,358,193 | B1 | * | 3/2002 | Nyberg | 494/2 |
| 6,468,574 | B1 | * | 10/2002 | Zettier | 426/491 |
| 6,837,842 | B1 | * | 1/2005 | Dellden | 494/2 |
| 7,485,084 | B2 | * | 2/2009 | Borgstrom et al. | 494/2 |
| 7,678,039 | B2 | * | 3/2010 | Åstrom | 494/37 |
| 7,758,488 | B2 | * | 7/2010 | Zettier et al. | 494/37 |
| 7,837,608 | B2 | * | 11/2010 | Klapper et al. | 494/37 |
| 8,337,378 | B2 | * | 12/2012 | Chan | 494/2 |
| 8,557,316 | B2 | * | 10/2013 | Pecoroni et al. | 426/231 |
| 2002/0068673 | A1 | | 6/2002 | Collier | |
| 2007/0173397 | A1 | | 7/2007 | Hinman et al. | |
| 2008/0171645 | A1 | * | 7/2008 | Borgstrom et al. | 494/2 |
| 2008/0257836 | A1 | | 10/2008 | Laughlin | |
| 2009/0137377 | A1 | * | 5/2009 | Astrom | 494/37 |
| 2009/0298666 | A1 | * | 12/2009 | Trager et al. | 494/10 |
| 2010/0081552 | A1 | * | 4/2010 | Chan | 494/3 |
| 2010/0184579 | A1 | * | 7/2010 | Trager | 494/56 |
| 2013/0029828 | A1 | * | 1/2013 | Haggmark et al. | 494/2 |
| 2015/0045199 | A1 | * | 2/2015 | Thorwid et al. | 494/2 |

FOREIGN PATENT DOCUMENTS

| | | | | |
|---|---|---|---|---|
| CA | 2527667 | A1 | | 1/2005 |
| DE | 102004035215 | A1 | | 2/2006 |
| SU | 1174090 | A | | 8/1983 |
| WO | 2007094715 | A1 | | 8/2007 |
| WO | WO 2011093784 | A1 | * | 8/2011 |

* cited by examiner

CENTRIFUGAL SEPARATOR WITH PRESSURE OR RECIRCULATION CONTROL OR MONITORING DEVICES

FIELD

The present invention relates to a system having a centrifugal separator.

SUMMARY OF THE INVENTION

The present invention relates to a system including a hermetic centrifugal separator, where the separator includes a rotor including a separation chamber, an inlet channel for a mixture of components to be separated, a first outlet channel for receiving one or more separated light components, a second outlet channel for receiving one or more separated heavy components, the system further including a recirculation means for recirculating from the second outlet channel to the separation chamber part of the separated heavy component.

According to a second aspect, the present invention relates to a method of controlling such a system including the following steps: feeding a mixture of components into a separation chamber from an inlet channel; separating the mixture of components in the separation chamber into light and heavy components; leading one or more light components into a first outlet; leading one or more heavy components into a second outlet; recirculating part of the separated heavy component from the second outlet into the inlet channel;

Such systems are used when the content of the heavy component in a mixture varies heavily or is constantly low, whereas it is often desired to obtain a separated sludge with a constant concentration, to e.g. avoid clogging in heavy phase outlet pipes.

It is an object of the present invention to provide an improved system including a hermetical centrifugal separator and a method of controlling such a system with which it is possible to control the heavy phase flow rate.

In accordance with the invention there is therefore provided a system including a centrifugal separator as initially described hereinabove, wherein a first monitoring means is monitoring density, flow rate, or a combination thereof, of the heavy component flowing in the second outlet channel, and a first control means is controlling recirculation flow in response to a control signal from the first monitoring means.

In a preferred embodiment of the present invention the system includes a second monitoring means monitoring flow rate of the heavy component flowing in the second outlet channel, and a second control means controlling the pressure by controlling a first back pressure valve in the first outlet channel in response to a control signal from the second monitoring means.

In a further preferred embodiment of the present invention the system includes a third monitoring means monitoring pressure in the second outlet channel, and a third control means controlling the pressure by controlling a second back pressure valve in the second outlet channel in response to a control signal from the third monitoring means.

In yet another preferred embodiment of the present invention the system the control means are controlling in response to a signal based on a difference between a control signal from the monitoring means and a desired set point for a monitored parameter.

In another preferred embodiment of the present invention the system includes a fourth monitoring means monitoring flow rate in the recirculation means, and a fourth control means controlling recirculation flow rate in response to a control signal from the fourth monitoring means, where the fourth control means is getting its set point from the output of the first control means.

According to an embodiment of the present invention the control means are PID controllers.

In another embodiment of the present invention the first control means is a MPC controller and the second, third and fourth control means are PID controllers, and where the first control means are supplying set points to one or more of the second, third and fourth control means.

In a further embodiment of the present invention the second outlet channel is connected to heavy component outlet pipes inside the separation chamber where the pipes have inlet openings close to the interior wall of the separator bowl.

In accordance with the second aspect of the invention there is provided a method as initially described hereinabove, wherein it further includes the following steps: monitoring parameters of density, flow rate or combination thereof, of the heavy component flowing in the second outlet channel; creating a control signal in relation to the parameter(s); and controlling the recirculation flow in response to the control signal.

According to an embodiment of this second aspect of the present invention the method includes the following steps: monitoring a parameter of flow rate, of the heavy component flowing in the second outlet channel; creating a second control signal in relation to the parameter of flow rate; and controlling the pressure in the first outlet channel by controlling a first back pressure valve in the first outlet channel in response to the second control signal.

In a further embodiment of this aspect of the present invention the method includes the following steps: monitoring a parameter of pressure in the second outlet channel; creating a third control signal in relation to the parameter of pressure; and controlling the pressure in the second outlet channel by controlling a second back pressure valve in the second outlet channel in response to the third control signal.

In another embodiment of this aspect of the present invention the method step of controlling includes computing a difference between the control signal and a desired set point for a monitored parameter.

In a further embodiment of this aspect of the present invention the method includes the steps of: monitoring a parameter of flow rate in the recirculation means; creating a fourth control signal in relation to the parameter of flow rate in the recirculation means; and controlling the recirculation flow rate in response to the fourth control signal, where the controlling includes computing of a difference between the fourth control signal and a set point which corresponds to the first control signal.

The invention thus provides a system and method which control the characteristics of the separated heavy component even when feeding the separator with a feed of varying contents.

The system and the method according to the invention are described below in a more detailed description of preferred embodiments of the present invention referring to the drawings FIGS. 1-4.

DETAILED DESCRIPTION

Figure 1:
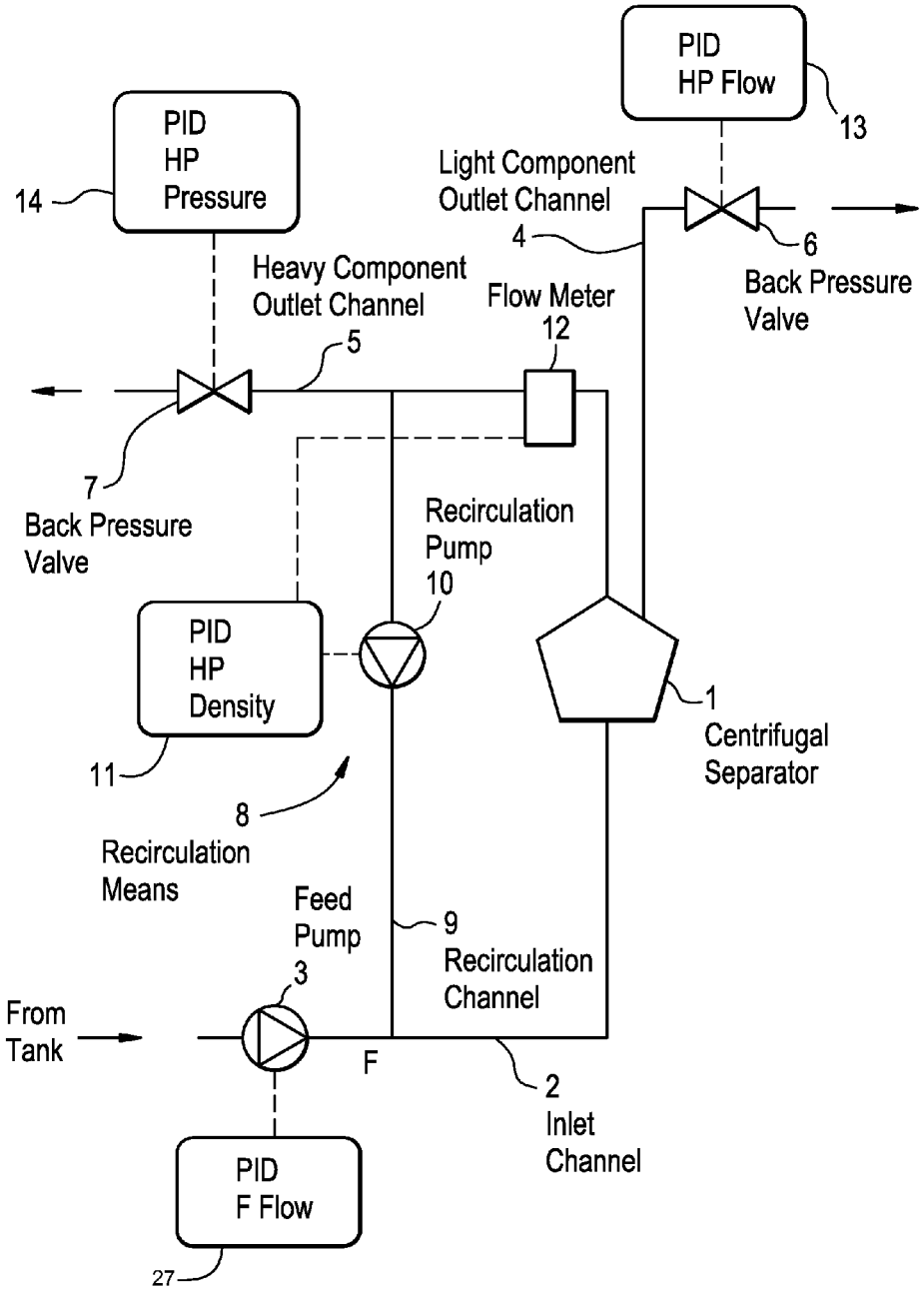
FIG. 1 is a flow chart of one embodiment of the system according to the present invention.

In FIG. 1 a centrifugal system disclosed, that includes a hermetic centrifugal separator 1, which is fed with a mixture of components to be separated through an inlet channel 2 by feeding pump 3. The feeding pump 3 is controlled by the feed pump PID (Proportional-Integral-Derivative) F Flow 27. In the separator 1 a liquid mixture of components centrifuged in a rotor with a separation chamber in which the components are separated. There is a first outlet channel 4 connected to the separation chamber for receiving one or more separated light components, and a second outlet channel 5 for receiving one or more separated heavy components.

In each outlet channel 4, 5 is a (first and second resp.) back pressure valve 6, 7 arranged. Leading from the second outlet channel 5 for heavy components to the inlet channel 2 a recirculation means 8 is arranged. The recirculation means 8 includes a recirculation channel 9 adapted to deviate part of the separated heavy component upstream of the second back pressure valve 7 and a recirculation pump 10 adapted to pump the part of the separated heavy component to the inlet channel 2.

The pumping flow of the recirculation pump 10 is controlled by a so called PID controller (Proportional-Integral-Derivative) 11 which responds continually or intermittently to a signal from a coriolis flow meter 12 located in the outlet channel 5 for heavy components. The signal derives from a calculated difference between a measured flow or density and a desired set point. It is for instance highly desirable that the outlet channel 5 is not subject to clogging as the continuous flow of heavy component is then interrupted. The desired set point may then be of a value that ascertains a continuing flow.

Also the back pressure valves 6, 7 are provided with PID controllers 13, 14.

The PID controller 13 controlling the back pressure valve 6 in the light component outlet channel 4 responds to a signal based on a difference between the heavy component flow in the outlet channel 5 and a desired set point of the same. The PID controller 11 is then responding to the density of the heavy component in the outlet channel 5.

The PID controller 14 controlling the back pressure valve 7 in the heavy component outlet channel 5 is responding to the back pressure in the heavy component outlet channel 5.

The idea is to control the recirculation flow to control the density while the light component valve 6 controls the heavy component pressure.

Figure 2:
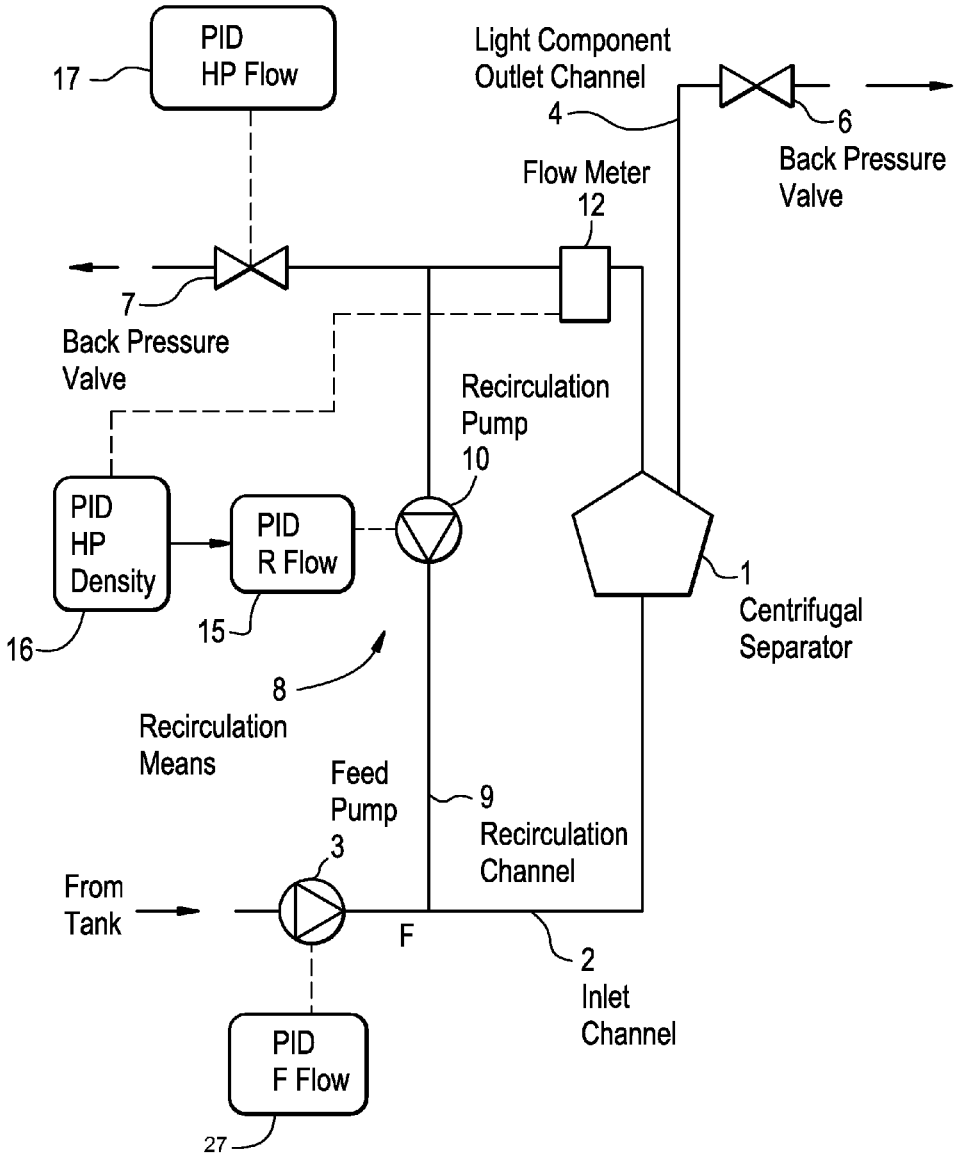
FIG. 2 is a flow chart of a second embodiment of the system according to the present invention.

This control strategy can be modified by adding a so called cascaded controller over the recirculation pump 10, as can be seen in FIG. 2. In cascade control there are two PIDs arranged with one PID controlling the set point of another. A PID controller acts as outer loop controller, which controls the primary physical parameter, such as fluid level or velocity. The other controller acts as inner loop controller, which reads the output of outer loop controller as set point, usually controlling a more rapid changing parameter, flow rate or acceleration.

In FIG. 2 a PID controller 15 is arranged in an inner loop controlling the recirculation flow in response to a signal based on the recirculation flow after the pump 10, and in an outer loop a PID controller 16, getting its control signal from the monitored density in the heavy component output channel, provides PID controller 15 with a set point.

The idea with cascaded controllers is that the inner loop is much faster than the outer loop. The outer controller thus considers the control signal (i.e. the set point to the inner loop) as being realized immediately because of the different time scales they operate in. The control is still decentralized, but now there is also the possibility of controlling the recirculation flow by setting its set point. A PID controller 17 controlling the heavy component back pressure valve 7 responds to a signal calculated from the heavy component flow monitored by the coriolis flow meter.

Figure 3:
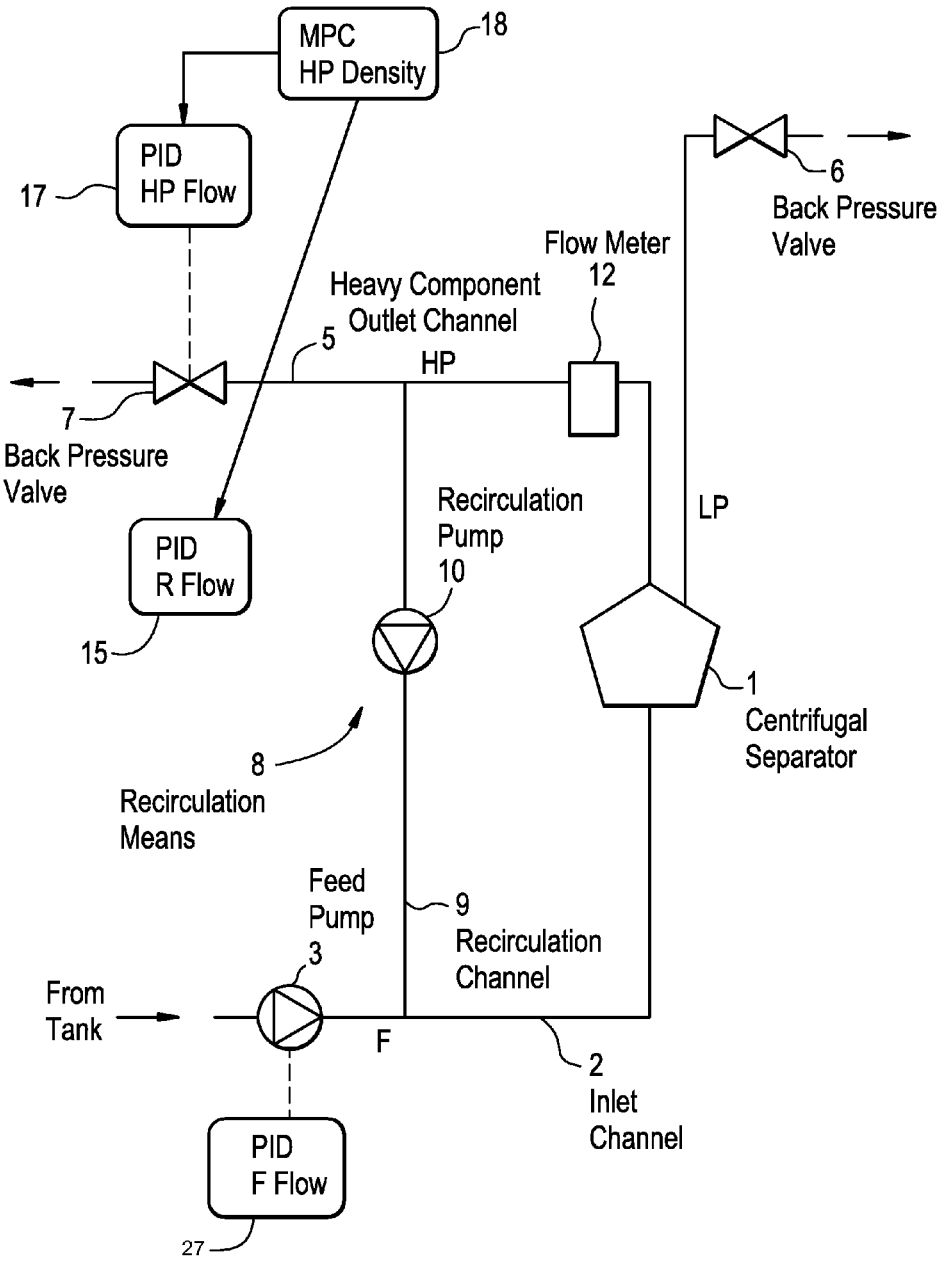
FIG. 3 is a flow chart of a third embodiment of the system according to the present invention.

In FIG. 3 is an embodiment of the system where a so called MPC controller 18 (Model Predictive Controller) is applied to manipulate the control signals directly and according a desired operation course. For example, when separating a mixture that varies in heavy component concentration during operation it is often preferred that the parameters controlled by the PID-controllers are regulated according to graphs that optimize the process in reference to e.g. efficiency, quality of the output and/or clogging risk. The MPC controller 18 is then controlling the reference values of the underlying controllers, i.e. the PID-controllers, meaning that the manipulated variables of the MPC controller are the set points for the PID-controllers (e.g. flow rate, density or pressure). This makes the whole control into a cascaded controller where the MPC controller is the outer loop for all the PID-controllers. The PID-controllers are configured as in FIG. 2 with the exception that the PID controller controlling the density in the heavy component outlet channel is deactivated. In this embodiment the MPC controller controls the density by setting reference values for the recirculation flow and the heavy component flow while the feed flow set point is held constant.

Figure 4:
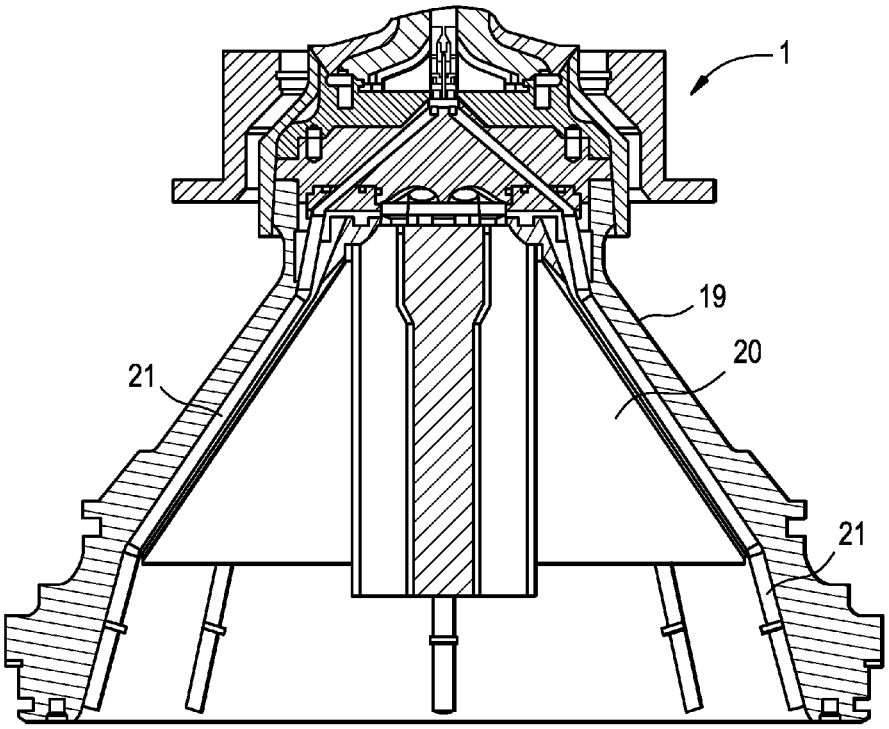
FIG. 4 is a sectioned side view of the upper part of a separator bowl according to an embodiment of the invention.

FIG. 4 discloses an upper part of a separator bowl 19 which separator bowl defines a separation chamber 20. The heavy components of the separated mixture will, due to the centrifugal forces, collect in the area most remote from the rotational axis i.e. close to the interior wall of the separator bowl. In conventional centrifugal separators the heavy components are discharged through ports in the periphery of the separator bowl 19 at certain intervals to prevent build up inside the separator. However, in the centrifugal separator according to the present invention, the heavy components are fed continuously from the separation chamber 20 out through a heavy component outlet channel 5 arranged on top of the separator bowl 19. The inside of the of the separator bowl 19 is therefore provided with heavy component outlet pipes 21 arranged on, in or close to the interior wall of the upper part of the separator bowl 19. The outlet pipes 21 follow the interior wall and extend upwards towards and connect to the heavy component outlet channel 5 and are thus leading the heavy components from the peripheral part of the separation chamber 20 radially inwards and upwards to the heavy component outlet channel 5. By choosing length of the heavy component pipes 21 and position for their inlet orifices in the separation chamber 20 it is possible to control the characteristics of the sludge fed to the pipes 21.

An application of the present invention discloses a system according to the present invention where the hermetic centrifugal separator is equipped with conventional ejection openings for optional intermittent discharge of sludge.

To a person skilled in the art the present invention is not limited by the described examples and several modifications and alternatives are possible within the scope of the present invention as defined by the claims.

The invention claimed is:

1. A system comprising:

a hermetic centrifugal separator, the separator comprising:

a rotor including a separation chamber, an inlet channel for a mixture of components to be separated, a first outlet channel for receiving at least one separated light component, and a second outlet channel for receiving at least one separated heavy component;

the system further comprising recirculation means for recirculating from said second outlet channel to said separation chamber part of the separated heavy component;

a first monitoring means monitoring density, flow rate, or combination thereof, of the heavy component flowing in said second outlet channel;

a first control means controlling recirculation flow rate in response to a control signal from said first monitoring means;

a pressure monitoring means for monitoring pressure in said second outlet channel; and a pressure control means for controlling the pressure by controlling a back pressure valve in said second outlet channel in response to a control signal from said pressure monitoring means.

2. A system according to claim 1, comprising:

a second monitoring means monitoring flow rate of the heavy component flowing in said second outlet channel, a second control means controlling the pressure by controlling a first back pressure valve in said first outlet channel in response to a control signal from said second monitoring means.

3. A system according to claim 1, wherein said first control means is controlling in response to a signal based on a difference between a control signal from said first monitoring means and a desired set point for a monitored parameter.

4. A system according to claim 1, comprising:

a recirculation monitoring means for monitoring flow rate in said recirculation means, a recirculation control means for controlling recirculation flow rate in response to a control signal from said recirculation monitoring means, where said recirculation control means receives a set point from the output of said first control means.

5. A system according to claim 1, wherein at least one of said first control means and said pressure control means are PID controllers.

6. A system according to claim 1, wherein said first control means is a MPC controller and pressure control means is a PID controller, and where said first control means is configured to supply set points to the pressure control means.

7. A system according to claim 1, wherein said second outlet channel is connected to heavy component outlet pipes inside the separation chamber where said pipes have inlet openings close to an interior wall of a separator bowl.

8. A system according to claim 1, wherein the hermetic centrifugal separator is equipped with ejection openings for optional intermittent discharge of sludge.

9. A method of controlling a system comprising:

providing a system comprising a hermetic centrifugal separator, the separator comprising a rotor including a separation chamber, an inlet channel for a mixture of components to be separated, a first outlet channel, and a second outlet channel having a back pressure valve therein; the system further comprising recirculation means in communication with said second outlet channel and said separation chamber; a first monitoring means in communication with the system, a first control means in communication with said first monitoring means; pressure monitoring means in said second outlet channel; and pressure control means in communication with the back pressure valve;

feeding a mixture of components into the separation chamber from an inlet channel;

separating said mixture of components in said separation chamber into light and heavy components;

leading at least one light component into the first outlet channel;

leading at least one heavy component into the second outlet channel;

recirculating part of the separated heavy component from said second outlet channel into said inlet channel;

monitoring parameters of density, flow rate or combination thereof, of the heavy component flowing in said second outlet channel;

creating a first control signal in relation to said parameters;

controlling the recirculation flow rate in response to said first control signal;

monitoring pressure in said second outlet channel; and controlling the pressure by controlling the back pressure valve in response to a second control signal from said pressure monitoring means.

10. A method according to claim 9 comprising the following steps:

monitoring a parameter of flow rate, of the heavy component flowing in said second outlet channel;

creating a flow rate control signal in relation to said parameter of flow rate;

and controlling pressure in said first outlet channel by controlling another a first back pressure valve in said first outlet channel in response to said flow rate control signal.

11. A method according to claim 9, wherein the step of controlling comprises:

computing of a difference between said first control signal and a desired set point for a monitored parameter.

12. A system comprising:

a hermetic centrifugal separator, the separator comprising:

a rotor including a separation chamber, an inlet channel for a mixture of components to be separated, a first outlet channel for receiving at least one separated light component, and a second outlet channel for receiving at least one separated heavy component;

the system further comprising recirculation means for recirculating from said second outlet channel to said separation chamber part of the separated heavy component;

a first monitoring means monitoring density, flow rate, or combination thereof, of the heavy component flowing in said second outlet channel;

a first control means controlling recirculation flow rate in response to a control signal from said first monitoring means;

a recirculation monitoring means for monitoring flow rate in said recirculation means; and a recirculation control means for controlling recirculation flow rate in response to a control signal from said recirculation monitoring means, where said recirculation control means receives a set point from the output of said first control means.

13. A system according to claim 12, further comprising:

a second monitoring means monitoring flow rate of the heavy component flowing in said second outlet channel, a second control means controlling the pressure by controlling a first back pressure valve in said first outlet channel in response to a control signal from said second monitoring means.

14. A system according to claim 12, further comprising:

a pressure monitoring means for monitoring pressure in said second outlet channel, a pressure control means for controlling the pressure by controlling a back pressure valve in said second outlet channel in response to a control signal from said third monitoring means.

15. A system according to claim 12, wherein said first control means is controlling in response to a signal based on a difference between a control signal from said first monitoring means and a desired set point for a monitored parameter.

16. A system according to claim 12, wherein at least one of said first control means and pressure control means are PID controllers.

17. A system according to claim 12, wherein said first control means is a MPC controller and said pressure control means is a PID controller and where said first control means is configured to supply set points to said pressure control means.

18. A system according to claim 12, wherein said second outlet channel is connected to heavy component outlet pipes inside the separation chamber where said pipes have inlet openings close to an interior wall of a separator bowl.

19. A system according to claim 12, wherein the hermetic centrifugal separator is equipped with ejection openings for optional intermittent discharge of sludge.

20. A method of controlling a system comprising:

providing a system comprising a hermetic centrifugal separator, the separator comprising a rotor including a separation chamber, an inlet channel for a mixture of components to be separated, a first outlet channel, and a second outlet channel having a back pressure valve therein; the system further comprising recirculation means in communication with said second outlet channel and said separation chamber; a first monitoring means in communication with the system, a first control means in communication with said first monitoring means; and recirculation monitoring means and recirculation control means in communication with said recirculation means;

feeding a mixture of components into the separation chamber from an inlet channel;

separating said mixture of components in said separation chamber into light and heavy components;

leading at least one light component into the first outlet channel;

leading at least one heavy component into the second outlet channel;

recirculating part of the separated heavy component from said second outlet channel into said inlet channel;

monitoring parameters of density, flow rate or combination thereof, of the heavy component flowing in said second outlet channel;

creating a first control signal in relation to said parameters;

controlling the recirculation flow rate in response to said first control signal;

monitoring flow rate in said recirculation means via said recirculation monitoring means;

controlling recirculation flow rate via said recirculation control means in response to a recirculation control signal from said recirculation monitoring means; and receiving via said recirculation control means, a set point from an output of said first control means.

21. A method according to claim 20, further comprising the following steps:

monitoring a parameter of flow rate, of the heavy component flowing in said second outlet channel;

creating a flow rate control signal in relation to said parameter of flow rate; and controlling pressure in said first outlet channel by controlling another back pressure valve in said first outlet channel in response to said flow rate control signal.

22. A method according to claim 20, further comprising the following steps:

monitoring a parameter of pressure in said second outlet channel;

creating a pressure control signal in relation to said parameter of pressure; and controlling pressure in said second outlet channel by controlling another back pressure valve in said second outlet channel in response to said pressure control signal.

23. A method according to claim 20, wherein the step of controlling comprises:

computing of a difference between said first control signal and a desired set point for a monitored parameter.

24. A system comprising:

a hermetic centrifugal separator, the separator comprising:

a rotor including a separation chamber, an inlet channel for a mixture of components to be separated, a first outlet channel for receiving at least one separated light component, and a second outlet channel for receiving at least one separated heavy component;

the system further comprising recirculation means for recirculating from said second outlet channel to said separation chamber part of the separated heavy component;

a first monitoring means monitoring density, flow rate, or combination thereof, of the heavy component flowing in said second outlet channel;

a first control means controlling recirculation flow rate in response to a control signal from said first monitoring means;

a second monitoring means monitoring flow rate of the heavy component flowing in said second outlet channel; and a second control means controlling the pressure by controlling a first back pressure valve in said first outlet channel in response to a control signal from said second monitoring means.

25. A system according to claim 24, further comprising:

a pressure monitoring means for monitoring pressure in said second outlet channel, a pressure control means controlling the pressure by controlling a second back pressure valve in said second outlet channel in response to a control signal from said pressure monitoring means.

26. A system according to claim 24, wherein said first control means is controlling in response to a signal based on a difference between a control signal from said first monitoring means and a desired set point for a monitored parameter.

27. A system according to claim 24, further comprising:

a recirculation monitoring means for monitoring flow rate in said recirculation means; and a recirculation control means for controlling recirculation flow rate in response to a control signal from said recirculation monitoring means, where said recirculation control means receives a set point from the output of said first control means.

28. A system according to claim 24, wherein at least one of said first control means and said pressure control means are PID controllers.

29. A system according to claim 24, wherein said first control means is a MPC controller and pressure control means is a PID controller, and where said first control means is configured to supply set points to the pressure control means.

30. A method of controlling a system comprising:

providing a system comprising a hermetic centrifugal separator, the separator comprising a rotor including a separation chamber, an inlet channel for a mixture of components to be separated, a first outlet channel having a back pressure valve therein, and a second outlet channel; the system further comprising recirculation means in communication with said second outlet channel and said separation chamber; a first monitoring means in communication with the system, a first control means in communication with said first monitoring means; a second monitoring means monitoring in said second outlet channel; and a second control means in communication with a back pressure valve in said first outlet channel;

feeding a mixture of components into the separation chamber from an inlet channel;

separating said mixture of components in said separation chamber into light and heavy components;

leading at least one light component into the first outlet channel;

leading at least one heavy component into the second outlet channel;

recirculating part of the separated heavy component from said second outlet channel into said inlet channel;

monitoring parameters of density, flow rate or combination thereof, of the heavy component flowing in said second outlet channel;

creating a first control signal in relation to said parameters;

controlling the recirculation flow rate in response to said first control signal;

monitoring with the second monitoring means flow rate of the heavy component flowing in said second outlet channel; and controlling pressure by controlling the back pressure valve in response to a control signal from said second monitoring means.

31. A method according to claim 3, further comprising the following steps:

monitoring a parameter of flow rate, of the heavy component flowing in said second outlet channel;

creating a flow rate control signal in relation to said parameter of flow rate; and controlling pressure in said first outlet channel by controlling the back pressure valve in response to said flow rate control signal.

32. A method according to claim 30, further comprising the following steps:

monitoring a parameter of pressure in said second outlet channel;

creating a pressure control signal in relation to said parameter of pressure; and controlling pressure in said second outlet channel by controlling another back pressure valve in said second outlet channel in response to said pressure control signal.

33. A method according to claim 30, wherein the step of controlling pressure comprises:

computing of a difference between said first control signal and a desired set point for a monitored parameter.

34. A system comprising:

a hermetic centrifugal separator, the separator comprising:

a rotor including a separation chamber, an inlet channel for a mixture of components to be separated, a first outlet channel for receiving at least one separated light component, and a second outlet channel for receiving at least one separated heavy component;

the system further comprising recirculation means for recirculating from said second outlet channel to said separation chamber part of the separated heavy component;

a first monitoring means monitoring density, flow rate, or combination thereof, of the heavy component flowing in said second outlet channel;

a first control means controlling recirculation flow rate in response to a control signal from said first monitoring means; and wherein said first control means is a MPC controller and pressure control means is a PID controller and said first control means is configured to supply set points to the pressure control means.

35. A system according to claim 34, further comprising:

a second monitoring means monitoring flow rate of the heavy component flowing in said second outlet channel; and a second control means controlling the pressure by controlling a back pressure valve in said first outlet channel in response to a control signal from said second monitoring means.

36. A system according to claim 34, further comprising:

a pressure monitoring means monitoring pressure in said second outlet channel; and a pressure control means controlling the pressure by controlling another back pressure valve in said second outlet channel in response to a control signal from said pressure monitoring means.

37. A system according to claim 34, wherein said first control means is controlling in response to a signal based on a difference between a control signal from said first monitoring means and a desired set point for a monitored parameter.

38. A system according to claim 34, further comprising:

a recirculation monitoring means for monitoring flow rate in said recirculation means, a recirculation control means for controlling recirculation flow rate in response to a control signal from said recirculation monitoring means, where said recirculation control means is configured to receive a set point from the output of said first control means.

39. A system according to claim 34, wherein at least one of said first control means and said pressure control means are PID controllers.

40. A method of controlling a system comprising:

providing a system comprising a hermetic centrifugal separator, the separator comprising a rotor including a separation chamber, an inlet channel for a mixture of components to be separated, a first outlet channel having a back pressure valve therein; and a second outlet channel; the system further comprising recirculation means in communication with said second outlet channel and said separation chamber; a first monitoring means in communication with the system, a first control means in communication with said first monitoring means, said first control means being a MPC controller; and pressure control means in communication with system, the pressure control means being a PID controller;

feeding a mixture of components into the separation chamber from an inlet channel;

separating said mixture of components in said separation chamber into light and heavy components;

leading at least one light component into the first outlet channel;

leading at least one heavy component into the second outlet channel;

recirculating part of the separated heavy component from said second outlet channel into said inlet channel;

monitoring parameters of density, flow rate or combination thereof, of the heavy component flowing in said second outlet channel;

creating a first control signal in relation to said parameters;

controlling the recirculation flow rate in response to said first control signal; and supplying, with said first control means, set points to the pressure control means.

41. A method according to claim 40 further comprising:

monitoring a parameter of flow rate, of the heavy component flowing in said second outlet channel;

creating a flow rate control signal in relation to said parameter of flow rate; and controlling pressure in said first outlet channel by controlling the back pressure valve in response to said flow rate control signal.

* * * * *